US009676460B2

(12) United States Patent
Aasebö

(10) Patent No.: US 9,676,460 B2
(45) Date of Patent: Jun. 13, 2017

(54) PROPULSION UNIT FOR MARITIME VESSEL

(71) Applicant: Rolls-Royce Marine AS, Aalesund (NO)

(72) Inventor: Steinar Aasebö, Gursköy (NO)

(73) Assignee: Rolls-Royce Marine AS, Aalesund (NO)

( * ) Notice: Subject to any disclaimer, the term of this patent is extended or adjusted under 35 U.S.C. 154(b) by 343 days.

(21) Appl. No.: 14/384,988

(22) PCT Filed: Mar. 14, 2013

(86) PCT No.: PCT/NO2013/050052

§ 371 (c)(1),
(2) Date: Sep. 12, 2014

(87) PCT Pub. No.: WO2013/137746

PCT Pub. Date: Sep. 19, 2013

(65) Prior Publication Data

US 2015/0203182 A1 Jul. 23, 2015

(30) Foreign Application Priority Data

Mar. 14, 2012 (NO) ..... 20120299

(51) Int. Cl.
*B63H 5/14* (2006.01)
*B63H 5/15* (2006.01)
(Continued)

(52) U.S. Cl.
CPC ..... *B63H 5/125* (2013.01); *B63H 5/14* (2013.01); *B63H 5/15* (2013.01); *B63H 21/165* (2013.01);
(Continued)

(58) Field of Classification Search
CPC ..... B63H 5/07; B63H 5/125; B63H 5/14; B63H 5/15; B63H 21/165; B63H 21/17;
(Continued)

(56) References Cited

U.S. PATENT DOCUMENTS 3,088,430 A 5/1963 Champney
3,707,939 A 1/1973 Berg
(Continued)

FOREIGN PATENT DOCUMENTS

NL 8801538 1/1990

OTHER PUBLICATIONS

International Search Report and Written Opinion mailed Jul. 2, 2013 (PCT/NO2013/050052).
(Continued)

*Primary Examiner* — Gregory Anderson
*Assistant Examiner* — Christopher R Legendre
(74) *Attorney, Agent, or Firm* — Alix, Yale & Ristas, LLP

(57) ABSTRACT

Propulsion unit (11) for propulsion and maneuvering of a maritime vessel, which includes a nozzle (12) wherein a propeller section (13, 13*a*) is arranged, which propeller section (13, 13*a*) is electrically or hydraulically driven, which propulsion unit (11) includes a fastening device (16) arranged for arrangement to hull of the vessel or to a steering device arranged for steering and/or moving the propulsion unit (11). The fastening device (16) is formed by two stems (17*a-b*) extending in parallel or laterally reversed about an vertical central axis from an upper surface of the nozzle (12) of the propulsion unit, which stems (17*a-b*) end in a fixing flange (18) for thereby providing an opening (19) which provides the propulsion unit (11) with improved hydrodynamic performance.

15 Claims, 5 Drawing Sheets

(51) Int. Cl.

| | |
|---|---|
| ***B63H 5/125*** | (2006.01) |
| ***B63H 21/165*** | (2006.01) |
| ***B63H 21/38*** | (2006.01) |
| ***B63H 23/00*** | (2006.01) |
| ***B63H 23/22*** | (2006.01) |
| ***B63H 21/17*** | (2006.01) |

(52) U.S. Cl.
CPC ..... *B63H 21/17* (2013.01); *B63H 21/38* (2013.01); *B63H 23/22* (2013.01); *B63H 2005/1258* (2013.01); *B63H 2023/005* (2013.01)

(58) Field of Classification Search
CPC B63H 21/38; B63H 23/22; B63H 2005/1258; B63H 2023/005
See application file for complete search history.

(56) References Cited

U.S. PATENT DOCUMENTS

| | | | | | |
|---|---|---|---|---|---|
| 3,708,251 | A * | 1/1973 | Pierro | B63H 5/125 | 310/263 |
| 4,304,558 | A * | 12/1981 | Holtermann | B63H 1/18 | 415/221 |
| 4,801,280 | A * | 1/1989 | Schuit | B63H 5/14 | 440/67 |
| 5,220,231 | A * | 6/1993 | Veronesi | B63H 1/16 | 310/90 |
| 5,389,020 | A * | 2/1995 | Clark | B63H 5/14 | 440/67 |
| 5,722,866 | A | 3/1998 | Brandt | | |
| 5,947,779 | A | 9/1999 | Heideman et al. | | |
| 6,837,757 | B2 | 1/2005 | Van Dine et al. | | |
| 9,452,812 | B2 * | 9/2016 | Aasebo | B63H 5/15 | |
| 2012/0093668 | A1 * | 4/2012 | Gieras | B63H 23/24 | 417/420 |
| 2015/0093241 | A1 * | 4/2015 | Aasebo | B63H 5/15 | 415/211.2 |
| 2015/0203182 | A1 * | 7/2015 | Aasebo | B63H 23/22 | 416/23 |
| 2015/0367921 | A1 * | 12/2015 | Aasebo | B63H 5/15 | 415/119 |

OTHER PUBLICATIONS

International Preliminary Report on Patentability dated Jul. 4, 2014 (PCT/NO2013/050052).

* cited by examiner

PROPULSION UNIT FOR MARITIME VESSEL

BACKGROUND

The present disclosure relates to a propulsion unit for propulsion and maneuvering of a vessel.

There are known propulsion units that include a propeller section which is fixed in a surrounding rotor part, in the periphery of which there are arranged permanent magnets or windings for providing magnetic field. The rotor part constitutes the rotor of an electrical motor and is positioned inside a surrounding stator part, which stator part is provided with magnetic devices or windings for generating magnetic field for causing rotation of the propeller section.

U.S. Pat. No. 5,220,231 discloses such a propulsion unit for a seagoing vessel. The propulsion unit has a centrally supported propeller section and a radially exterior positioned ring which rotates with a small radial distance from the stator part.

Common for present solutions is that these types of propulsion units are arranged to the vessel hull or a steering device by means of one stem. Solutions like these are, among others, known from U.S. Pat. No. 6,837,757, DE 2744913 A1 and U.S. Pat. No. 3,708,251.

There are several disadvantages of using only one stem which extends between an upper part of the propeller nozzle and the hull or a steering device. Among others, this one stem often creates drag, something which will result in turbulent flow at the top of the nozzle. This turbulent flow will result in directional change of flow which is led into the propellers, which results in that the propeller blades being exposed to variation in pressure and velocity of the inflowing water, ultimately resulting in a reduction in efficiency, and increased noise and vibration.

A solution which partly solves this is described in RU2096254 C2. In RU2096254 C2 it is described a vessel propeller arranged in a nozzle. The nozzle is fixed to the vessel hull by means of two separate frame parts by the use of vibration dampening means. The two frame parts are fixed separately to the hull and this solution can thus not be rotated. A similar solution is also described in U.S. Pat. No. 6,837,757 where two stems extend with a V-shape from the propeller nozzle to the hull for increased fastening stability and short stem cord length. This solution can neither be rotated as it is fixed directly to the vessel.

There is an increasing focus on reducing the energy requirement for the use of all propulsion units for propulsion and maneuvering of vessels. There are continuously set restricting demands for emission of environmentally unfriendly gases and the fuel costs are continuously increasing, all of which have led to an increased focus on developing novel solutions, among others, optimization of propeller blades and development of hybrid systems for propulsion of the vessels.

There is thus a need for providing a propulsion unit which provides reduced generation of turbulence, improved efficiency, and reduced noise and vibration compared to prior art.

There is also a need for providing a propulsion unit which has lower weight, without sacrificing sufficient strength.

SUMMARY

The disclosure provides a propulsion unit for propulsion and maneuvering of a vessel which solves the above-mentioned disadvantages of prior art.

The disclosed propulsion unit provides reduced turbulence, improved efficiency of the propeller, and reduction of noise and vibration compared to prior art.

The disclosed propulsion unit is also lower in weight and comparable in strength to similar units known in the prior art.

An embodiment of the propulsion unit also includes a fastening device for arrangement of the propulsion unit to a hull of the vessel or a steering device, which fastening device includes two stems which extend laterally reversed or in parallel about a substantially vertical axis from an upper surface of the nozzle of the propulsion unit ending in a fixing flange, thereby providing an opening which assists in improving hydrodynamic performance of the propulsion unit.

The disclosed propulsion unit for propulsion and maneuvering of maritime vessels is adapted for arrangement to a hull of a vessel or a steering device and may be arranged for rotating the propulsion unit 0-360 degrees, a limited number of degrees, pivotable movement of the propulsion unit, swinging the propulsion unit out or in of the hull of the vessel, or similar.

The propulsion unit includes a nozzle wherein a propeller section is electrically or hydraulically driven for propulsion and maneuvering of the vessel.

The propulsion unit is typically fixed to the hull of the vessel or to a steering device by a specially shaped fastening device.

The fastening device includes two stems extending laterally reversed or in parallel about a substantially vertical central axis from an upper surface of the nozzle of the propulsion unit ending in a fixing flange, thereby providing an opening which improves the hydrodynamic performance of the propulsion unit.

The disclosed propulsion device reduces turbulence, improves efficiency of the propeller, and reduces noise and vibration.

The described propulsion unit is lower in weight compared with known units, while maintaining strength necessary for its intended use.

The described stems may also be utilized for feed-through of cables for energy supply and controlling, hydraulic hoses or pipes.

Further preferable features and details of the inventive propulsion unit will appear from the following description of the preferred embodiments.

BRIEF DESCRIPTION OF THE DRAWINGS

The present invention will now be described in detail with references to the attached drawings, where.

DETAILED DESCRIPTION

Figure 1:
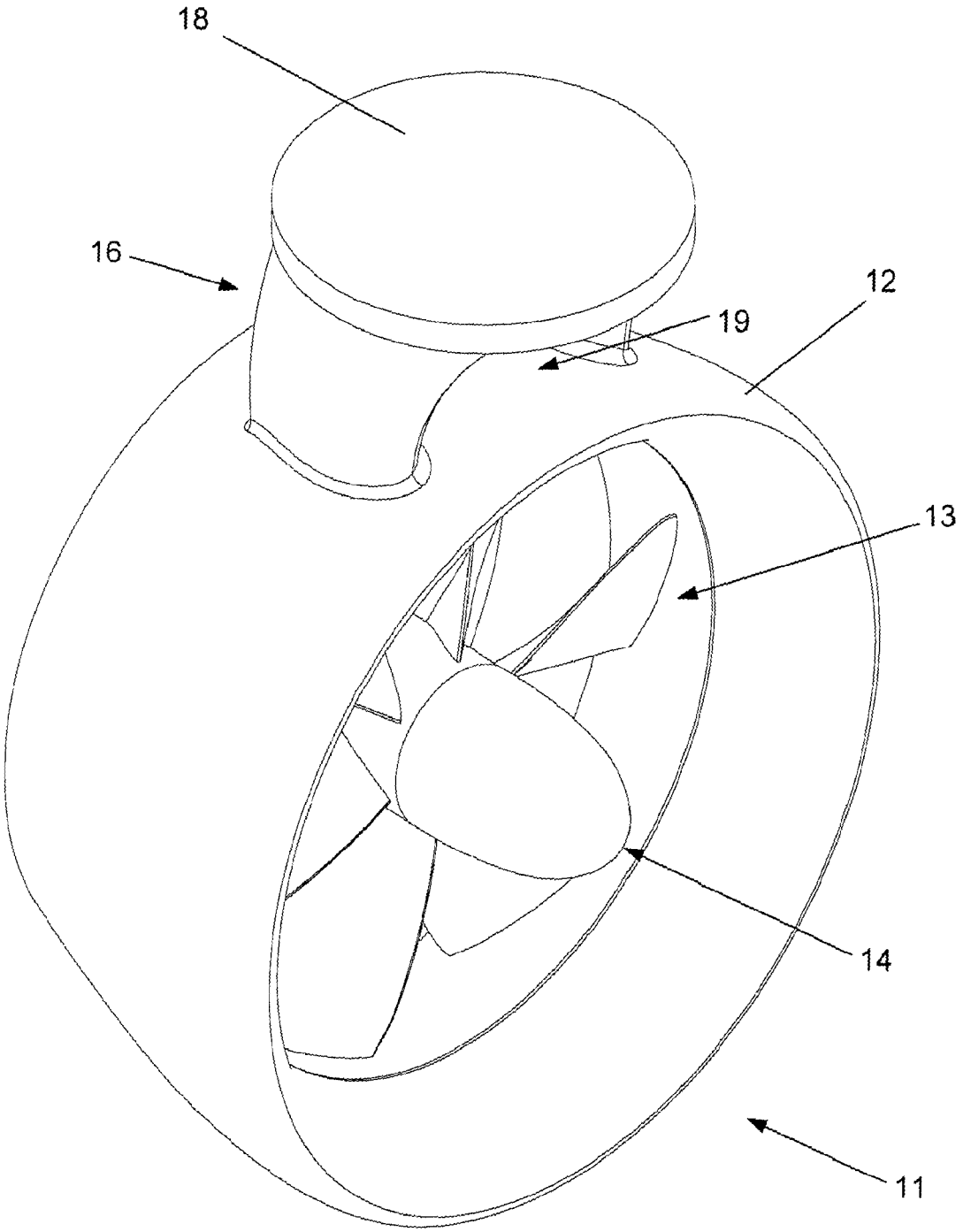
FIG. 1 shows a perspective view of a propulsion unit for propulsion and maneuvering of a maritime vessel according to the invention.

Reference is now made to FIG. 1 which shows an embodiment of a propulsion unit 11 for propulsion and maneuvering of a maritime vessel for arrangement to a hull of the vessel or a steering device arranged for rotating the propulsion unit 0-360 degrees, tiltable movement, swinging the propulsion unit out of or into the hull of the vessel or similar. The propulsion unit 11 includes a tubular nozzle 12 having a propeller section 13 having a central hub 14 rotatably arranged in the nozzle 12 by means of stays (not shown) which are fixed to the nozzle 12.

Figure 2:
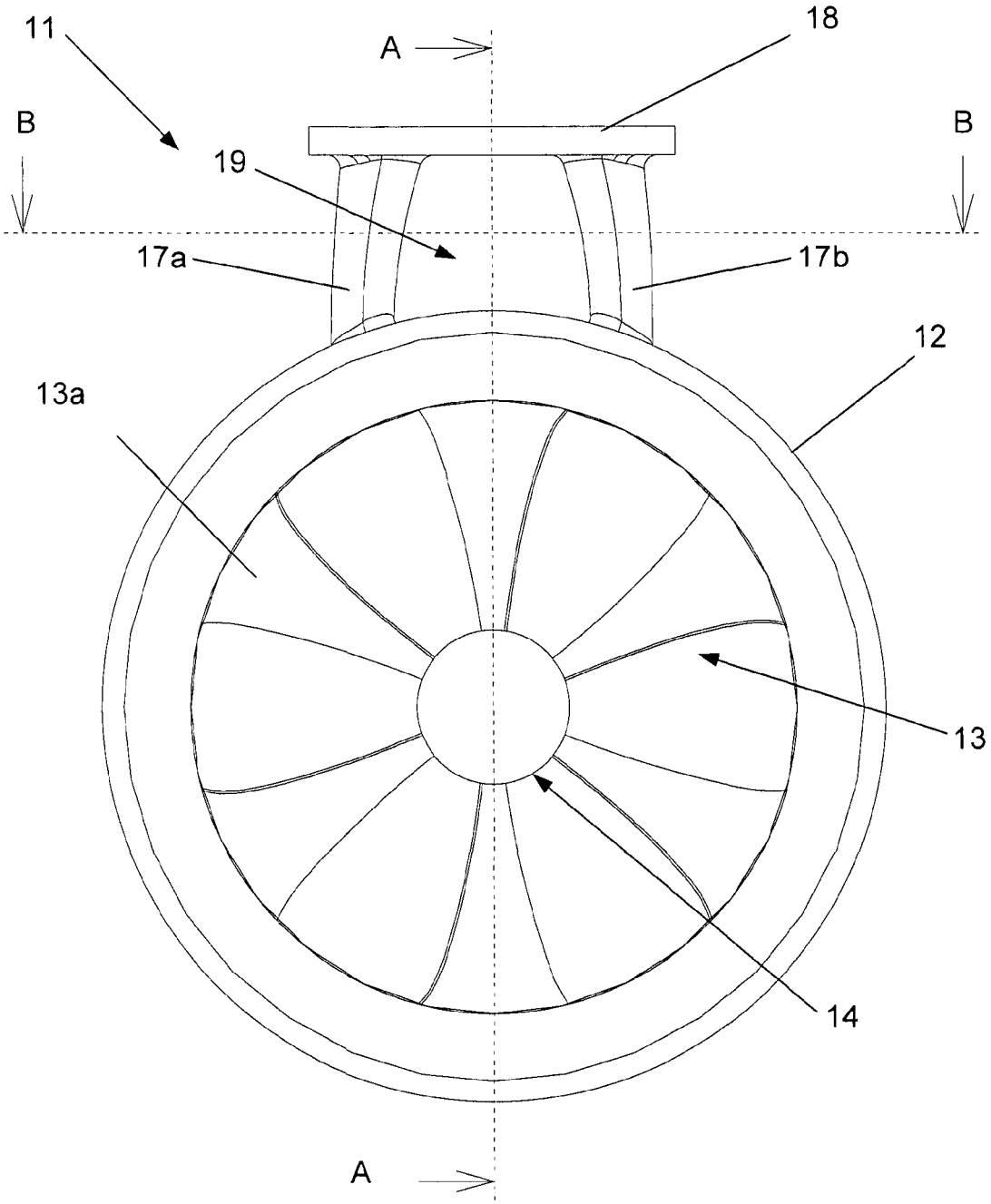
FIG. 2 shows a front view of the propulsion unit in FIG. 1.
Figure 3:
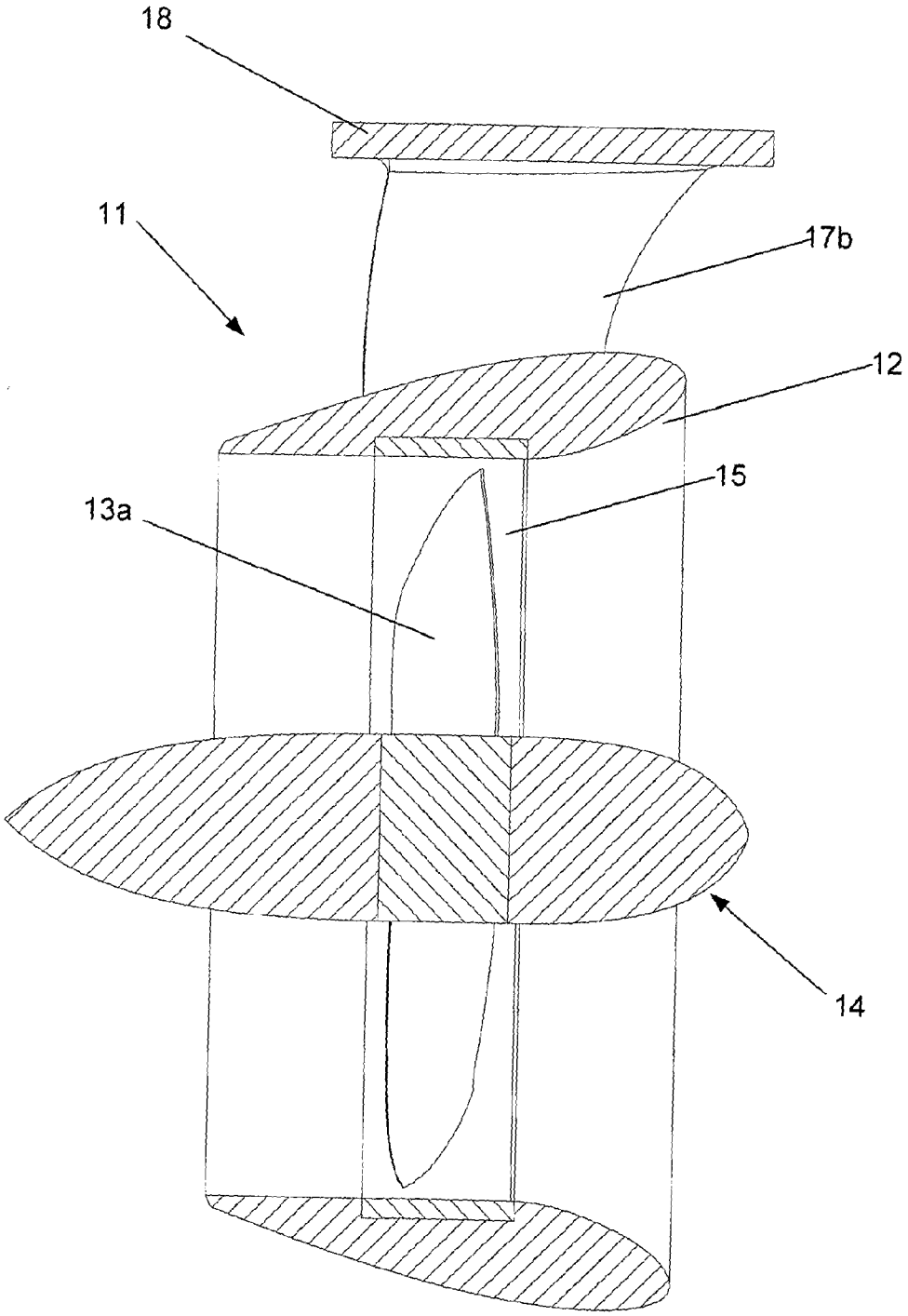
FIG. 3 shows a cross-sectional view of the propulsion unit in FIGS. 1 and 2, along the line A-A in FIG. 2.
Figure 4:
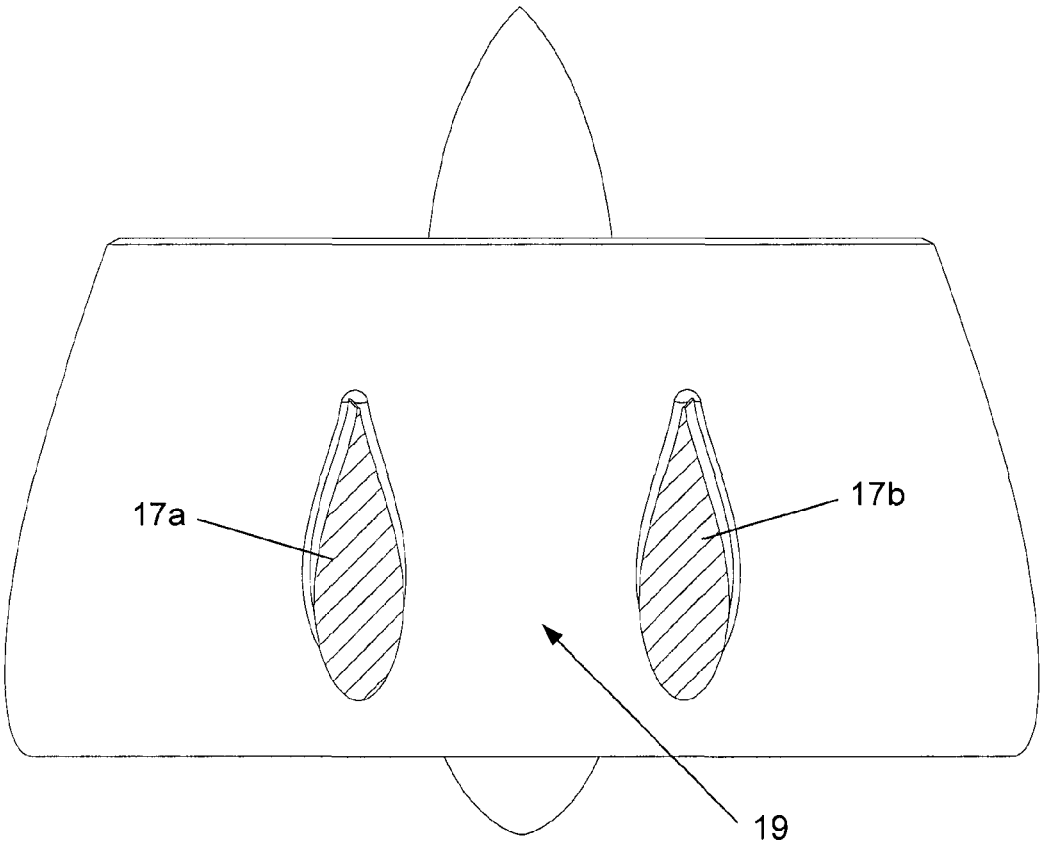
FIG. 4 shows a cross-sectional view of the propulsion unit in FIGS. 1 and 2, along the line B-B in FIG. 2.

Reference is now made to FIG. 2 which shows the propulsion unit 11 in FIG. 1, seen from the front, along the longitudinal axis of the propulsion unit 11. As can be seen in FIG. 2 the propeller section 13 includes six propeller blades 13*a*, but it can of course include more or fewer propeller blades. The propeller blades 13*a* extend mainly radially between the central hub 14 and an annular rotor part 15 (FIG. 3) which surrounds the propeller section 13, and to which the propeller blades 13*a* are fixed. This appears in a better way by observing FIG. 3, which shows a cross-sectional view of the propulsion unit 11, along the intersectional line A-A in FIG. 2. The annular rotor part 15 is rotatably arranged inside a stator part (not shown), preferably in a recess in the nozzle 12 so that the rotor part 15 is positioned outside the flow of water through the nozzle 12. A number of permanent magnets are arranged to the outer periphery of the rotor part 15. The permanent magnets are positioned a short distance from a plurality of windings fixed to the stator part, in such a way that magnetic fields for force application onto the magnets can be generated by supplying electric current in the windings, for controllable and regulated rotation of the rotor part 15, and hence also the propeller section 13. There is a gap between the exterior surface of the rotor part 15 and an opposite inner surface of the stator part, which will be filled with water when the propulsion unit 11 is submersed. There also exist solutions which utilize gas for replacing the water in the gap for achieving reduced loss in the gap. These features are well known within the art.

The disclosed propulsion unit 11 improves turbulence issues around the nozzle, improves efficiency for the propulsion unit, and reduces noise and vibration compared to prior art. The unit further reduces weight without sacrificing strength, compared with prior art solutions.

The propulsion unit 11 includes a fastening device 16 for arrangement of thereof to the hull of the vessel or steering devices as mentioned above. The fastening device 16 of a propulsion unit 11 includes two stems 17*a-b* arranged to an upper surface of the nozzle 12 by means of suitable fastener(s) (not shown), which stems 17*a-b* extend, laterally reversed or in parallel about a substantially vertical central axis (coincident with cross-section axis A-A indicated in FIG. 2), up from the nozzle 12 and terminating in a fixing flange 18.

The two stems 17*a-b* have a design which corresponds to a wing- or rudder-shape optimization of hydrodynamics, so that they reduce turbulence, noise or vibrations. The stems are further preferably longer than they are thick, preferably as slim as possible while maintaining sufficient strength.

The stems 17*a-b* further preferably have a shape that extends with a curved profile in a direction of the front of the nozzle for moving the center of gravity, i.e. so that the central point through the flange becomes positioned in front of the propeller for thereby reducing steering moment which is needed for turning the propulsion unit. This results in less lateral forces in connection with rotation, i.e. the propulsion unit can be dimensioned for lower steering moment. As the steering moment is reduced, the propulsion unit may be dimensioned smaller, thus reducing cost.

The stems 17*a-b* and fixing flange 18 form in this way an opening 19 over the nozzle 12 for allowing flow of water passing on the outside of the nozzle 12.

The distance between the stems 17*a-b*, length of the stems 17*a-b* and size of the opening 19 is a balance between required strength and design for achieving best possible hydrodynamic performance.

If the distance between the stems e.g. is too long, this will result in that the stems 17*a-b* will be too long as they will need to extend further down on the nozzle, resulting in an increase in drag. In the opposite case, if the distance is too short, strength is reduced.

In addition to this the stems and the opening will be dimensioned in relation to the size/effect of the propulsion unit, i.e. that a propulsion unit having higher effect/larger size will have a larger opening/longer distance between the stems than a propulsion unit with lower effect/smaller size.

It is further preferable that the stems 17*a-b* are arranged at a distance from the front of the nozzle. With the stems 17*a-b* arranged at a distance from the front of the nozzle, water passing on the outside of the nozzle does not meet a front and is lead back into the nozzle. The farther back on the nozzle the stems are arranged, i.e. the larger distance from the front of the nozzle, the smaller the effect on the propeller, something which will increase the efficiency of the propulsion unit. If one stem were utilized, the size would have to be massive to provide sufficient strength, and would have to extend far back and forth on the nozzle, resulting in water flowing on the outside of the nozzle meeting the front of the stem and thus being led back and into the nozzle, something which will result in low efficiency of the propeller.

It is preferable that the stems 17*a-b* be arranged far back on the nozzle and have a curved shape so that the flange 18 is positioned as far forward as possible. With two stems these can be drawn back and exhibit the necessary strength, something which is not possible with one stem.

There are many advantages with a fastening device 16 like this. The fact that two stems 17*a-b* ending in a fixing flange 18 are used, so that a hydrodynamical opening 19 is formed considerably reduces the generation of turbulent inflow at the top of the nozzle 12. In this way the propulsion unit 11 exhibits improved operating conditions and due to this the propeller section 13 achieves considerably improved efficiency. This results in considerably reduced power requirements for powering the propulsion unit 11.

With two stems 17*a-b* a reduction in weight of the propulsion unit 11 may be achieved since the two stems will accommodate forces and vibrations so that a single massive stem is not required, and the stems together with the fixing flange 18 provide a rigid construction. With only one stem, the unit will need to be dimensioned for all of the forces and vibrations, something which thus will result in a heavier propulsion unit.

The inventive propulsion unit achieves improved hydrodynamic performance and thereby reduction in noise and vibrations.

Even though it in the description above is shown one example of a propulsion unit, it is obvious that the propulsion unit can include a periphery-supported propeller section or a centrally supported propeller section.

Figure 5:
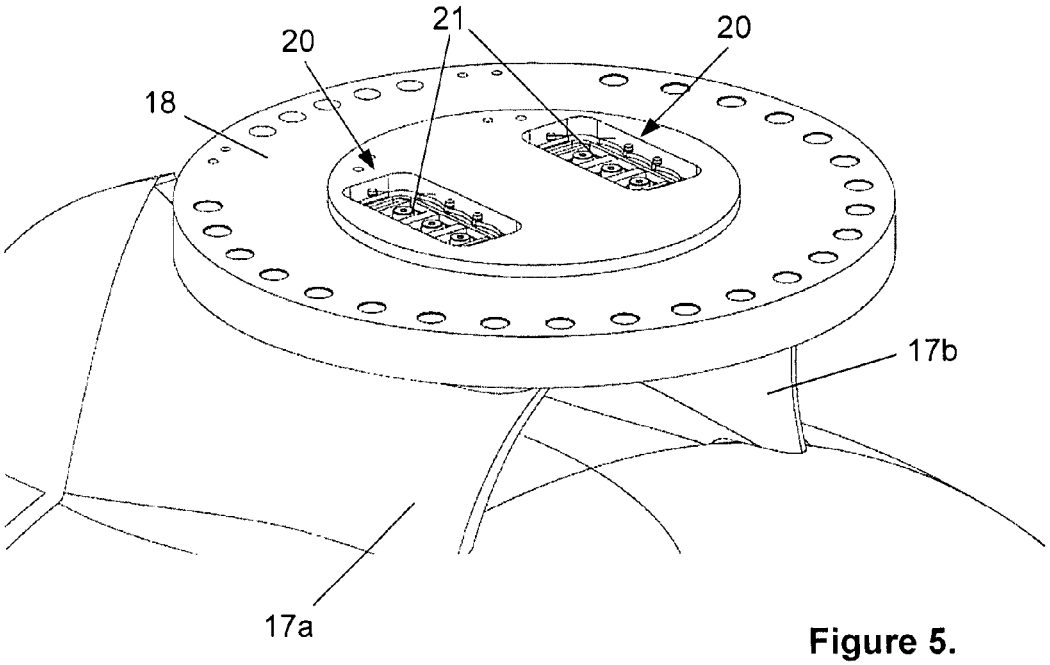
FIG. 5 shows details of feed-through of cables in the stems.

Reference is now made to FIG. 5 which shows details of the feed-through of energy supply and control cables for a propulsion unit according to the disclosure. The cables are arranged from the stator through the stems 17*a-b* and through recesses 20 arranged in a central area of the flange 18 for connection to an external control unit for controlling of the propulsion unit. The cables are in the recesses preferably adapted with a quick release coupling or conventional coupling, such as termination block 21, adapted for connection or termination to a corresponding termination block (not shown) arranged in a fastening point in the hull of the vessel or arranged in the fastening point of a steering device arranged for steering and/or moving the propulsion unit. The number of cables can of course vary and one can e.g. use one stem for arrangement of control signals and one stem for arrangement of energy supply.

For example, in a hydraulic propulsion unit, one stem can be used for supply of hydraulic fluid and one stem for return of hydraulic fluid. In cases of hydraulic drive one can arrange a quick release coupling for pipes or hydraulic hoses in the recesses 20. In this way the feed-through of cables, hydraulic hoses or pipes or similar from the vessel are arranged hidden so that they are not exposed to damage, and that the recesses result in that connections can be adapted so that the fastening point build as little as possible.

The fixing flange preferably exhibits a rounded shape, such as an ellipse-shape or a mainly circular shape so that it does not exhibit edges which can result in turbulence, noise or vibrations.

The invention claimed is:

1. A rotatable propulsion unit (11) for propulsion and maneuvering of a maritime vessel including a nozzle (12) wherein an electrically or hydraulically driven propeller section (13, 13*a*) is arranged, the propulsion unit (11) including a fastening device (16) arranged for arrangement of a steering device for steering or moving the propulsion unit (11), the fastening device (16) being formed by two stems (17*a-b*) extending in parallel or laterally reversed about a substantially vertical central axis from an upper surface of the nozzle (12) of the propulsion unit, the stems (17*a-b*) extending with equal or decreasing distance therebetween from the upper surface of the nozzle (12) to a fixing flange (18) and terminating in the fixing flange (18) for providing a single connection point for arrangement to the steering device and a joining connection point for cables for energy supply and controlling, hydraulic hoses or pipes, the stems (17*a-b*), upper surface of the nozzle (12) and fixing flange (18) providing an opening (19) which assists in improvement of hydrodynamic performance of the propulsion unit, wherein the nozzle (12) has an inlet and the stems (17*a-b*) are arranged a distance from the inlet back on the nozzle (12) and extend with a curved profile in a direction of the inlet for moving the center of gravity so that a central point through the fixing flange (18) is positioned in front of the propeller section (13, 13*a*), thereby reducing steering moment which is needed for rotation of the propulsion unit.

2. The propulsion unit of claim 1, wherein a distance between the stems (17*a-b*), length of the stems (17*a-b*) and size of the opening (19) are dimensioned for low generation of turbulent flow at the top of the nozzle (12), and reduction of noise and vibrations in the propulsion unit (11).

3. The propulsion unit of claim 1, wherein the stems (17*a-b*) have a design corresponding to a wing or rudder shape for hydrodynamic optimization, thereby minimizing turbulence, noise or vibrations.

4. The propulsion unit of claim 3, wherein the stems (17*a-b*) have a thickness and a length that is longer than said thickness.

5. The propulsion unit of claim 4, wherein the fixing flange (18) includes central recesses (20) allowing feed-through of cables, hydraulic hoses or pipes between the stems (17*a-b*).

6. The propulsion unit of claim 3, wherein the fixing flange (18) includes central recesses (20) allowing feed-through of cables, hydraulic hoses or pipes between the stems (17*a-b*).

7. The propulsion unit of claim 1, wherein a distance between the stems (17*a-b*), length of the stems (17*a-b*) and size of the opening (19) are balanced between desired strength and design.

8. The propulsion unit of claim 1, wherein a distance between the stems (17*a-b*), length of the stems (17*a-b*) and size of the opening (19) are dimensioned in relation to size effect of the propulsion unit.

9. The propulsion unit of claim 1, wherein the propeller section (13, 13*a*) has a periphery at which it is supported.

10. The propulsion unit according to claim 1, wherein the propeller section (13, 13*a*) has a center at which it is supported.

11. The propulsion unit of claim 1, wherein the stems (17*a-b*) are arranged for feed-through of cables, hydraulic hoses or pipes.

12. The propulsion unit of claim 11, wherein the fixing flange (18) is provided with recesses (20) in a central part thereof for feed-through of cables, hydraulic hoses or pipes between the stems (17*a-b*) and the steering device for steering or moving the propulsion unit (11).

13. The propulsion unit of claim 1, wherein the fixing flange (18) includes central recesses (20) allowing feed-through of cables, hydraulic hoses or pipes between the stems (17*a-b*), and the steering device for steering or moving the propulsion unit (11).

14. The propulsion unit of claim 13, wherein the recesses (20) in the fixing flange (18) are adapted for arrangement of couplings for cables, hydraulic hoses or pipes.

15. The propulsion unit of claim 1, wherein the fixing flange (18) includes central recesses (20) allowing feed-through of cables, hydraulic hoses or pipes between the stems (17*a-b*).

* * * * *